US007721377B2

(12) United States Patent
Jungklaus et al.

(10) Patent No.: US 7,721,377 B2
(45) Date of Patent: May 25, 2010

(54) EXTENDABLE HANDLE FOR DRYWALL TOOLS

(75) Inventors: Matt Jungklaus, Lawrenceville, GA (US); David J. Castagnetta, Jr., Lawrenceville, GA (US)

(73) Assignee: Axia Acquisition Corporation, Duluth, GA (US)

( * ) Notice: Subject to any disclaimer, the term of this patent is extended or adjusted under 35 U.S.C. 154(b) by 1406 days.

(21) Appl. No.: 11/110,107

(22) Filed: Apr. 19, 2005

(65) Prior Publication Data

US 2006/0230564 A1 Oct. 19, 2006

(51) Int. Cl.
*B25G 1/04* (2006.01)

(52) U.S. Cl. ..... 15/144.4; 15/144.1; 15/235.8; 16/429; 16/900

(58) Field of Classification Search ..... 15/144.4, 15/235.4, 144.3, 245.1, 235.8; 403/109.1, 403/109.3, 109.7, 374.5, 377–378, 322.3, 403/322.4; 16/429, 436, 900
See application file for complete search history.

(56) References Cited

U.S. PATENT DOCUMENTS

| | | | | |
|---|---|---|---|---|
| 2,934,937 | A | 5/1960 | Bennett | |
| 3,090,984 | A | 5/1963 | Dunnigan | |
| 3,105,262 | A | 10/1963 | Lathrop et al. | |
| 3,146,481 | A | 9/1964 | Chiuchiarelli | |
| 4,185,936 | A * | 1/1980 | Takahashi | 403/104 |
| 4,592,797 | A | 6/1986 | Carlson | |
| 4,761,092 | A * | 8/1988 | Nakatani | 403/104 |
| 5,088,147 | A * | 2/1992 | MacMillan | 15/144.4 |
| 5,625,923 | A * | 5/1997 | Huang | 16/429 |
| 5,791,805 | A | 8/1998 | Lynch et al. | |
| 6,260,238 | B1 * | 7/2001 | MacMillan | 16/429 |
| 6,367,121 | B1 | 4/2002 | MacMillan | |
| 6,412,138 | B1 | 7/2002 | MacMillan | |
| 6,551,226 | B1 * | 4/2003 | Webber et al. | 482/148 |
| 2002/0081146 | A1 * | 6/2002 | Tomm | 403/109.1 |

FOREIGN PATENT DOCUMENTS

| | | |
|---|---|---|
| DE | 100 54 612 | 10/2001 |
| WO | WO 02/051562 | 7/2002 |

* cited by examiner

*Primary Examiner*—Laura C Guidotti
(74) *Attorney, Agent, or Firm*—Michael Best & Friedrich LLP

(57) ABSTRACT

An extendable handle for a drywall tool having a pair of telescoping tubes that are reversibly locked in place relative to each other by a locking assembly comprising a lever, a pin and a yoke that are mounted on a base positioned on a first tube. The pin is actuated by the lever and engages an opening on the second tube to lock the tubes in place. The pin and lever are spaced apart circumferentially on the handle and are connected by the yoke. The yoke is received in a slot in the base and does not extend beyond the surface of base during operation of the lever.

23 Claims, 8 Drawing Sheets

EXTENDABLE HANDLE FOR DRYWALL TOOLS

BACKGROUND OF THE INVENTION

The present invention relates to drywall tools for applying mastic and especially to extendable handles for use with drywall tools.

Drywall tools, such as flat finishing tools for applying mastic to drywall joints, are typically provided with extendable handles that permit the user to comfortably reach areas of the drywall near the floor or ceiling. Such handles comprise an inner tube that telescopes within an outer tube to change the length of the handle. The tubes may be reversibly locked together relative to each other to fix a variable length of the handle during use. In conventional drywall tools, the tubes are locked together by a pin located on the outer tube that alternately engages one of a series of holes along the length of the inner tube. The pin is positioned at one end of a rocking lever that is spring-biased to engage the pin in one of the holes of the inner tube and lock the inner and outer tubes together. To change the length of the handle, the user applies pressure to the other end of the rocking lever against the spring-bias with his thumb to disengage the pin from the hole and allow the tubes to telescope freely. Once the handle has been extended or shortened to its desired length, the user releases the switch, allowing the pin to engage the appropriate hole on the inner tube and fix the length of the handle.

Because the rocking lever must be operated by the user's thumb, such conventional locking mechanisms can be awkward and tiring to use. Furthermore, as the user actuates the rocking lever, his hand or fingers may inadvertently become caught in the locking mechanism. To prevent such injury, the rocking lever is typically enclosed by walls positioned on either side of the locking mechanism. However, these walls make it difficult to access the locking mechanism for cleaning and repair. Thus, there is a need for a flat finishing tool with an extendable handle that is simpler and safer to operate, and that has a locking mechanism whose parts are readily accessible for cleaning and repair.

SUMMARY OF THE INVENTION

In accordance with an embodiment of the present invention, an extendable handle for a drywall tool comprises first and second members slidably coupled to each other. A locking element is positioned on a first side of the handle, for reversibly locking the first and second members in place relative to each other. A lever is positioned on a second side of the handle for actuating the locking element. In a preferred embodiment, the first member has at least one opening. A locking assembly is positioned on the second member for reversibly locking the first and second members in place relative to each other. The locking assembly comprises a base, a lever pivotally connected to the base, a pin and a yoke. The lever and the pin are spaced apart circumferentially on the handle and are connected by the yoke. The first and second members are reversibly locked together when the pin engages the opening in the first member.

In a further embodiment, the extendable handle includes a plate for mounting a drywall tool on the handle. The plate is rotatably connected to the second member and a brake is provided for controlling the rotation of the plate relative to the handle. A grip is positioned on the handle and coupled to the brake by a rod, and the movement of the grip actuates the brake. The rod has first and second ends, the first end coupled to the grip and the second end coupled to the brake. The distance between the grip and the second end of the rod is adjustable.

DETAILED DESCRIPTION OF THE INVENTION

Figure 1:
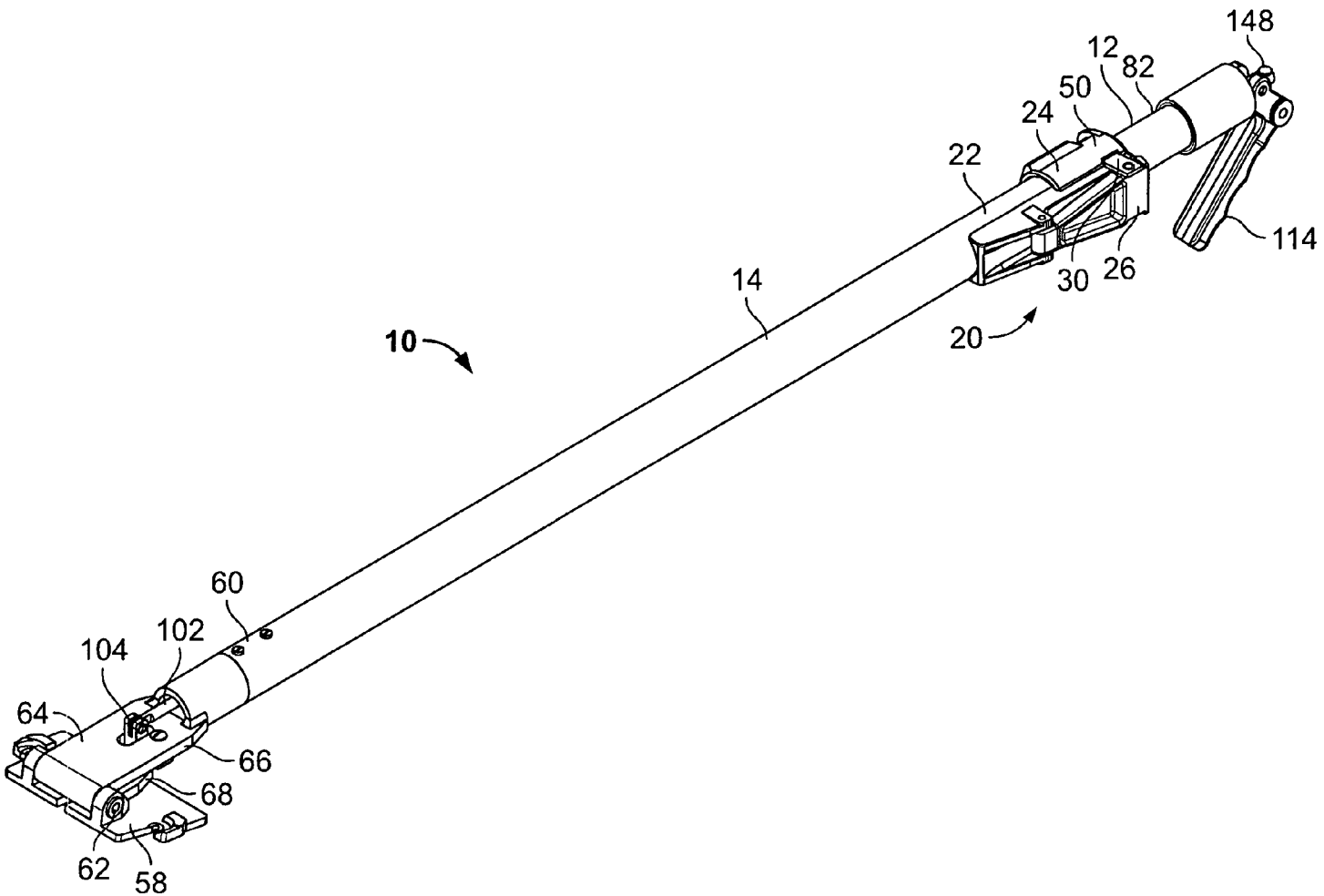
FIG. 1 is a perspective view of an extendable handle for a dry wall tool.
Figure 2:
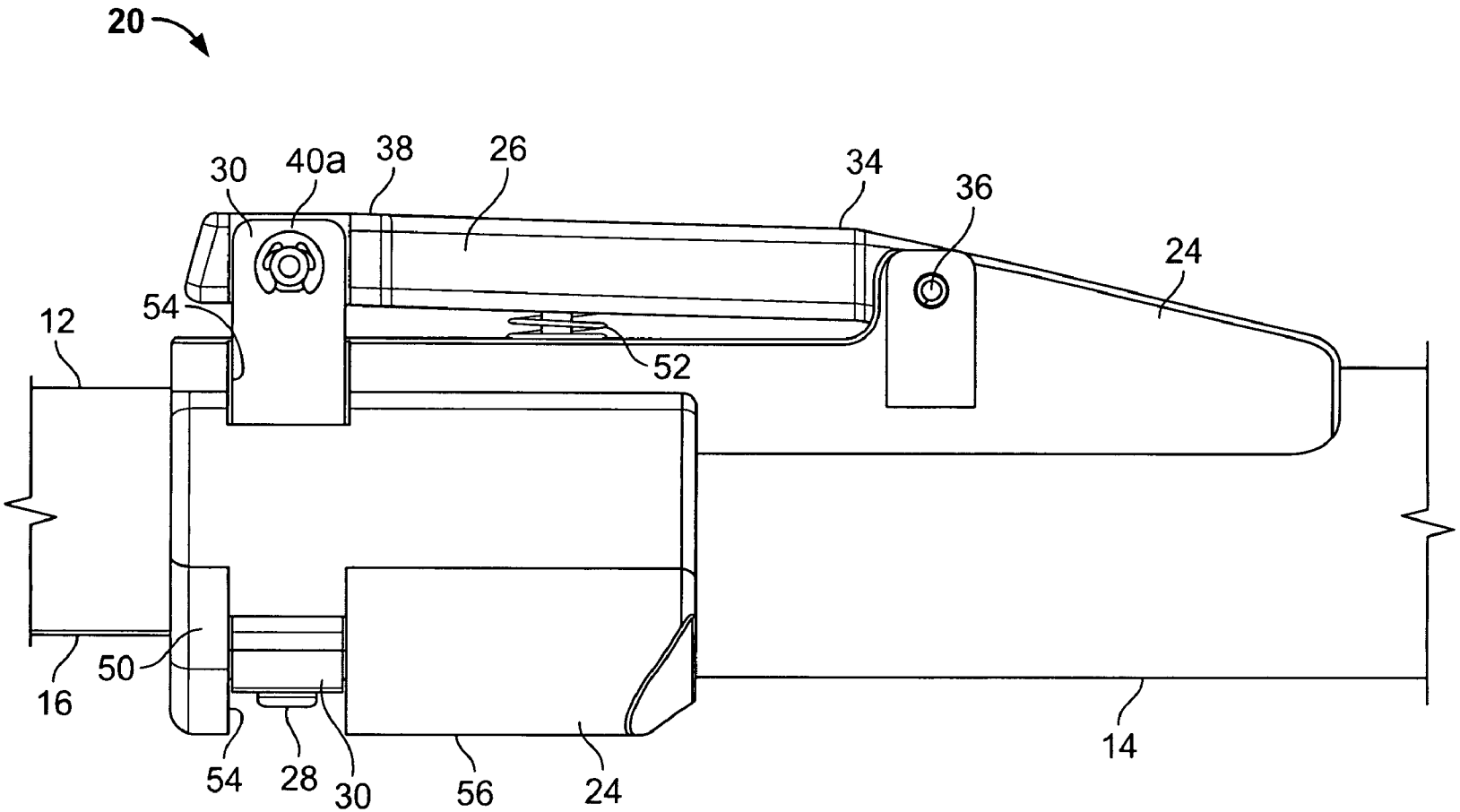
FIG. 2 is a detail side elevation view of the locking assembly of the handle of FIG. 1.
Figure 3:
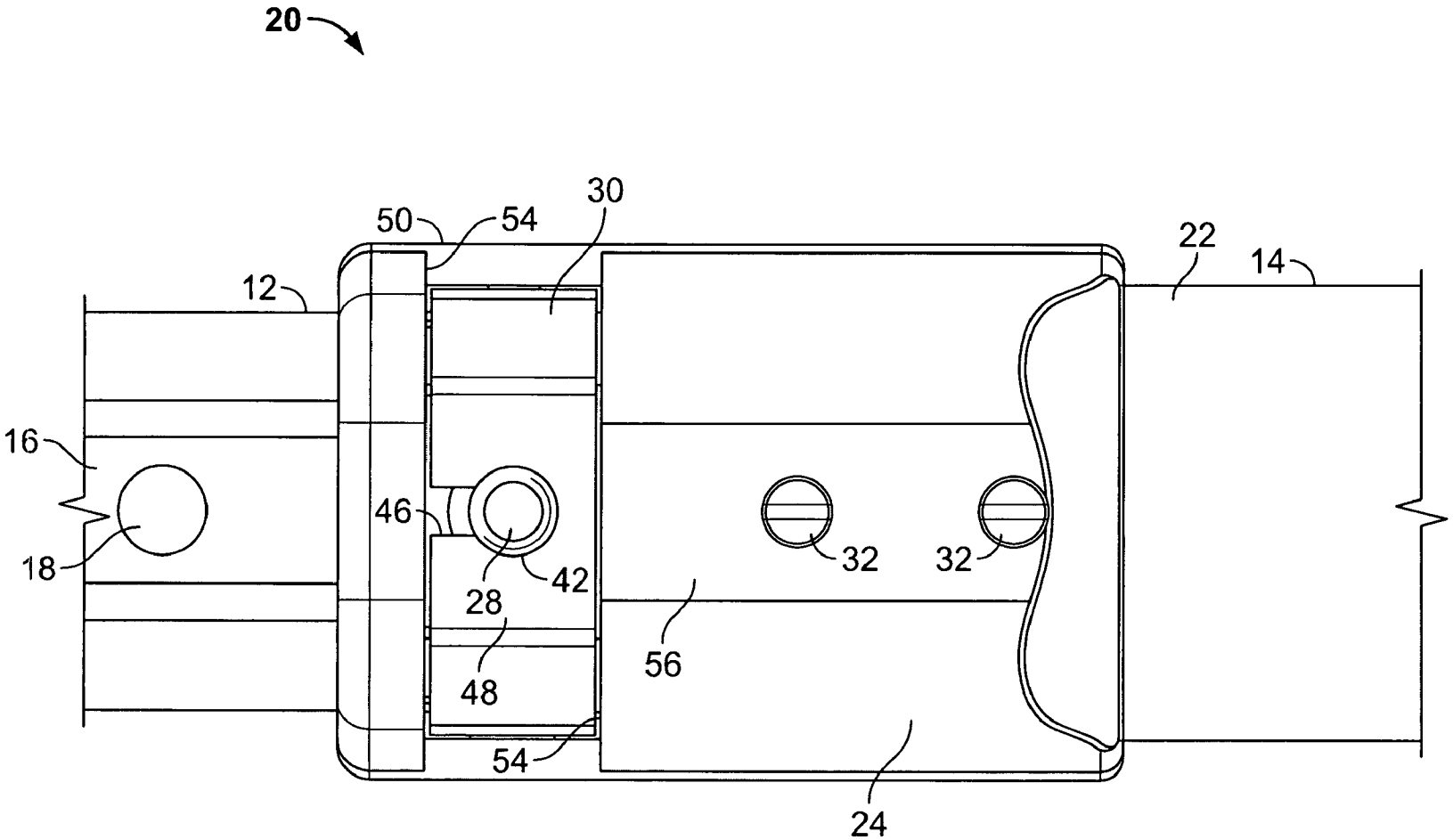
FIG. 3 is a detail bottom plan view of the locking assembly of the handle of FIG. 1.

Referring to FIG. 1, extendable handle 10 for a drywall tool is shown, comprising an outer tube 14 that is slidably coupled to an inner tube 12, such that the inner tube telescopes within the outer tube. As best shown in FIGS. 2 and 3, inner tube 12 has a D-shaped cross-section with a flat face 16. A series of holes 18 are formed in flat face 16 and disposed along the length of inner tube 12.

The D-shape provides inner tube 12 with increased strength and resistance to bending, and prevents the inner tube from inadvertently twisting or rotating within outer tube 14. In a preferred embodiment, the plane of flat face 16 is oriented generally parallel to the direction of the bending forces experienced by handle 10 during use, such as the pressure applied to the handle by the user and the weight of the drywall tool. Where the drywall tool is a flat finishing tool that is used to apply mastic to a wall with a vertical motion, the plane of flat face 16 is oriented perpendicular to the floor.

The length of handle 10 is changed by telescoping inner tube 12 within outer tube 14 until the appropriate length is achieved and then reversibly locking the inner and outer tubes in place relative to each other to fix the length of the handle. As described in detail below, inner and outer tubes 12, 14 are locked together by a lever actuated lock. The lever and lock are spaced apart circumferentially on the handle, to reduce the chance that the user's hand or fingers may become caught in the mechanism of the lock or between the lever and a tube when the lever is operated. Although the locking mechanism described herein comprises a locking pin 28 that engages a corresponding opening 18, other types of locks may be used. For example, inner and outer tubes 12, 14 may be reversibly locked together by a friction lock or ratcheting mechanism, as are well known in the art.

Figure 4:
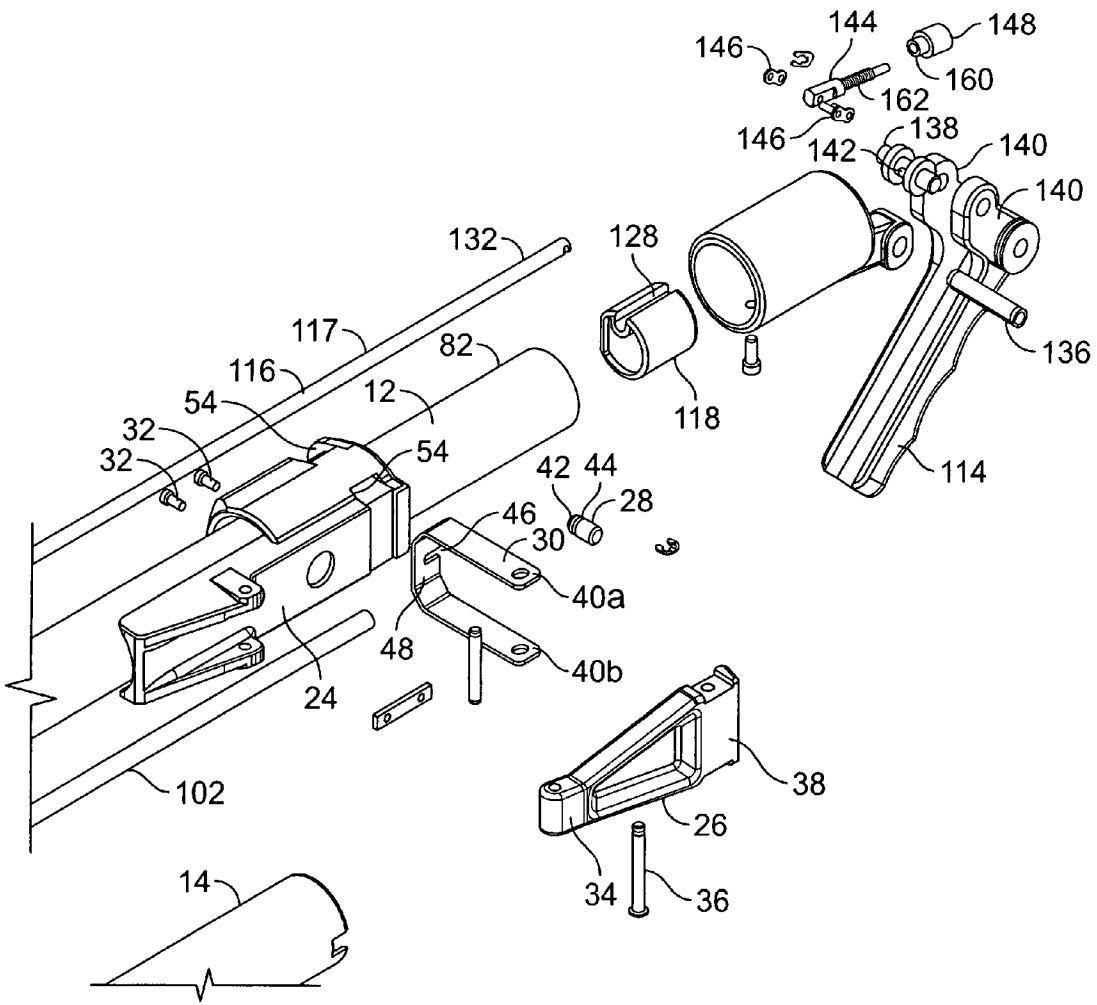
FIG. 4 is an exploded detail view of the locking assembly and brake grip of the handle of FIG. 1.

As shown in FIGS. 2-4, a locking assembly 20 is positioned at end 22 of outer tube 14, that comprises a base 24, a locking lever 26, a locking pin 28 and yoke 30. Base 24 encircles outer tube 14 and is attached to end 22 by screws 32. Locking lever 26 has a generally elongated triangular shape with a narrow end 34 connected to base 24 by a pivot 36, and a wide end 38 that provides a relatively broad surface for the user to manually operate the lever. Yoke 30 is connected to locking lever 26, and extends at least partially around handle 10. In a preferred embodiment, yoke 30 is generally U-shaped and extends around base 24, such that ends 40*a*, 40*b* of yoke 28 are attached to either side of wide end 38 of locking lever 26. In an alternative embodiment, locking lever 26 and locking pin 28 are connected at either end of yoke 30. Locking pin 28 is connected to yoke 30, and is spaced apart circumferentially from locking lever 26 on handle 10. In a preferred embodiment, locking pin 28 is positioned on handle 10 diametrically opposite locking lever 26. As best shown in FIGS. 3 and 4, the head 42 of locking pin 28 is provided with a groove 44 that is received in a slot 46 formed in the middle portion 48 of yoke 30.

In the locked position, locking pin 28 is engaged in one of holes 18, which prevents inner tube 12 from sliding relative to outer tube 14 and fixes the length of handle 10. A portion 50 of base 24 extends longitudinally beyond end 22 of outer tube 12, such that wide end 38 of locking lever 26, locking pin 28 and yoke 30 overlap inner tube 12. A spring 52 is positioned between base 24 and locking lever 26 to bias wide end 38 of the locking lever away from the base. The action of spring 52 causes wide end 38 to pull yoke 30 and bias locking pin 28 toward inner tube 12 and into engagement with one of holes 18. To change the length of handle 10, the user operates locking lever 26 by applying hand pressure to wide end 38 against the spring 52 bias, which causes yoke 30 to withdraw locking pin 28 from the locked position by disengaging the locking pin from hole 18. The user then slides inner tube 12 relative to outer tube 14 until the desired length of handle 10 is achieved and locking pin 28 is aligned with the appropriate alternate hole 18. Locking lever 28 is released to allow the bias of spring 52 to cause locking pin 28 to engage an alternate hole 18 and again reversibly lock inner tube 12 and outer tube 14 in position relative to each other.

To prevent the user's hand or fingers from being accidentally caught in the mechanism of locking assembly 20, base 24 is provided with a slot 54 for receiving yoke 30. Slot 54 is sized and shaped such that yoke 30 is recessed within the slot and does not extend radially beyond the outer surface 56 of base 24 during the operation of locking lever 26. Because locking assembly 20 does not require any walls to protect the user from the locking mechanism, as in conventional extendable handles, locking assembly is readily accessible for cleaning and repair. In a preferred embodiment, locking pin 28 is positioned on handle 10 diametrically opposite from locking lever 26, which further reduces the risk that the user's hand will become caught in the movement of locking pin 28 while operating locking lever 26. In addition, the user may maintain his normal grip on handle 10 and apply pressure to locking lever 26 with his palm, which makes locking assembly 20 more comfortable to operate and permits the user to exert more force on the locking lever than conventional extendable handles that are thumb operated.

Figure 6:
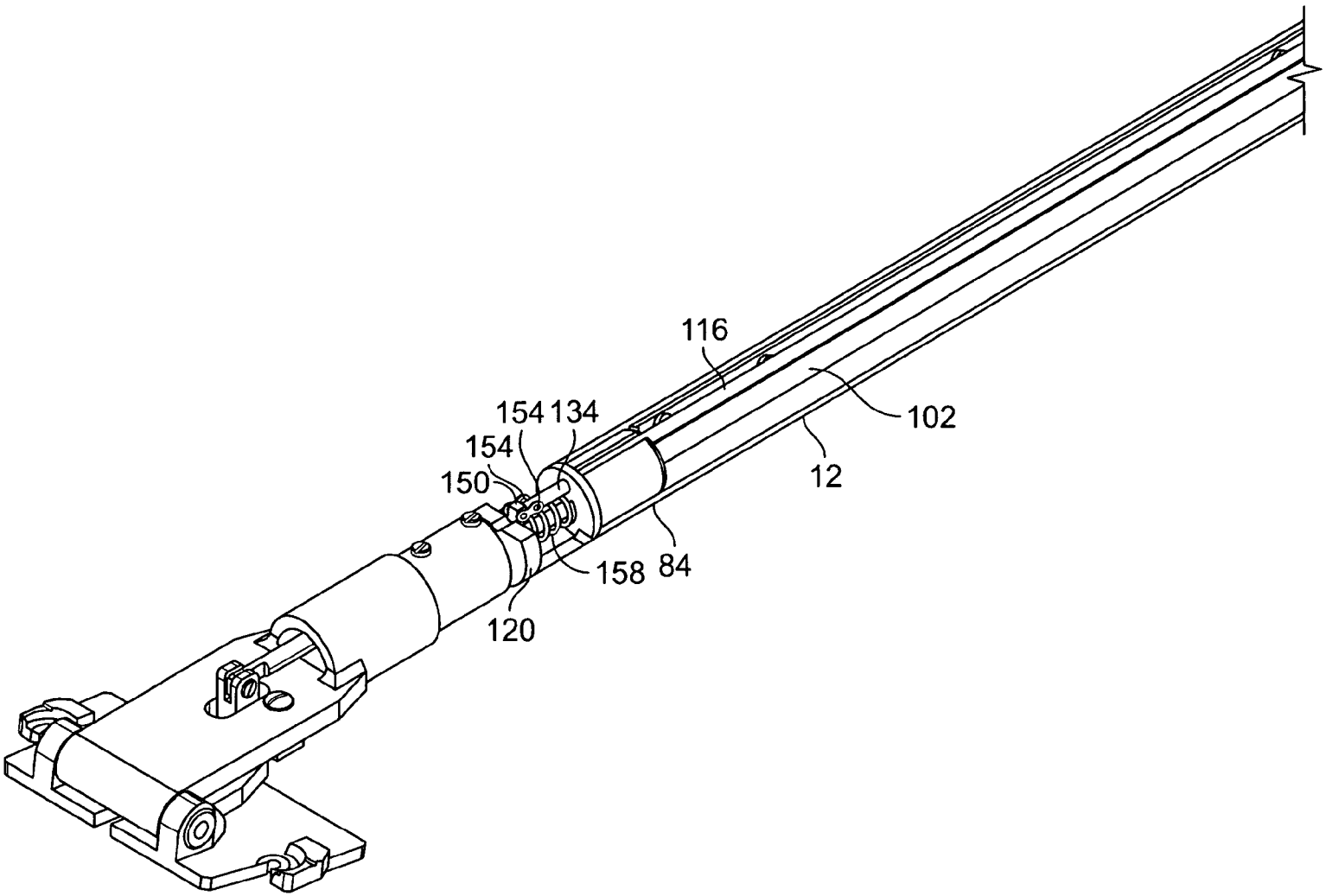
FIG. 6 is a partial cut away detail perspective view of the drywall tool attachment plate and brake assembly of the handle of FIG. 1.
Figure 7:
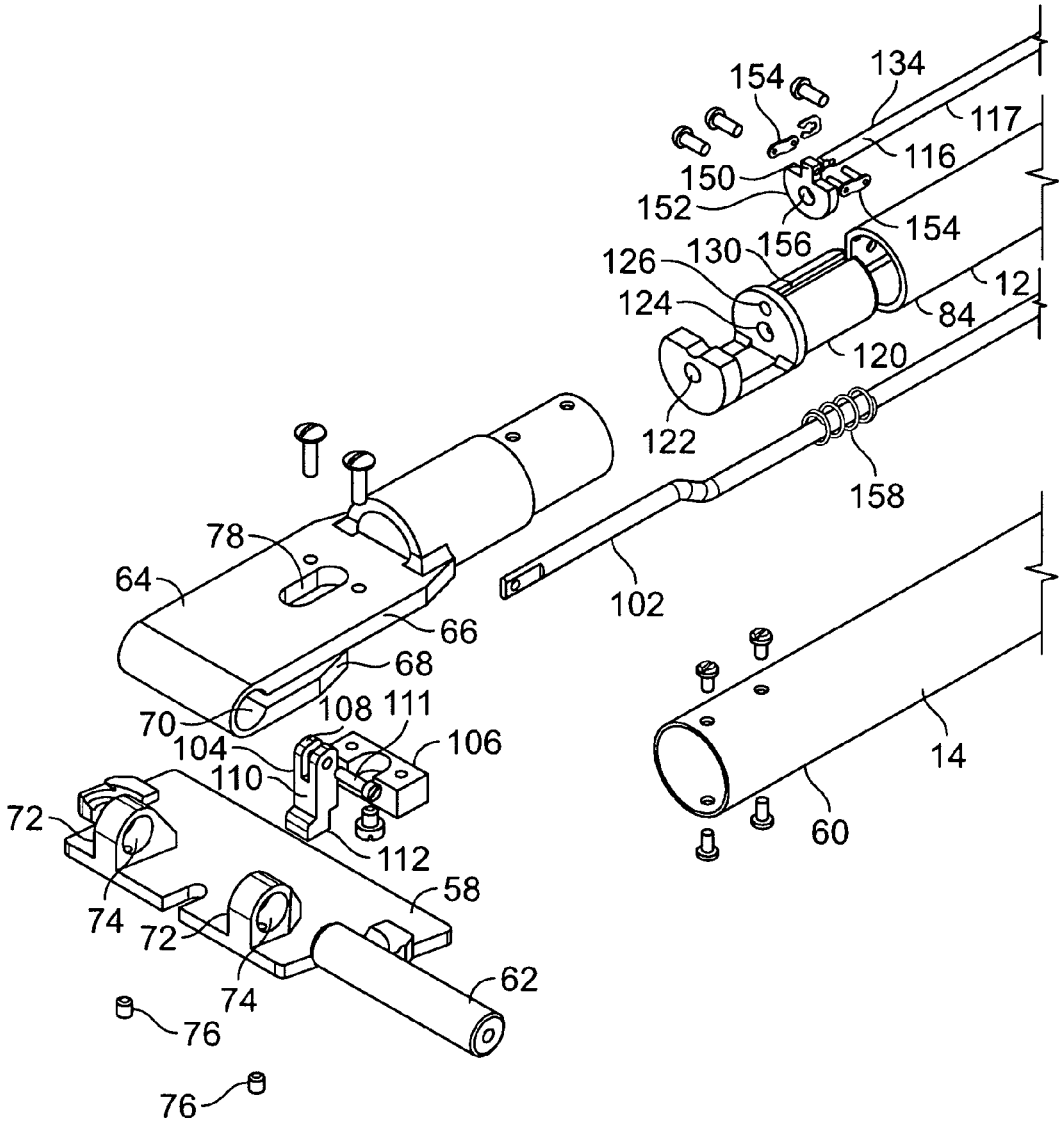
FIG. 7 is an exploded detail view of the drywall tool mounting plate and brake assembly of the handle of FIG. 1.

A plate 58 is provided for mounting a drywall tool, such as a head for dispensing mastic, to handle 10. In the embodiment shown in FIGS. 5-7, plate 58 is adapted to connect to a flat finishing box (not shown), and is pivotally coupled to the end 60 of outer tube 14 by a pin 62. As best shown in FIG. 7, end 60 of outer tube 14 has a U-shaped clamp 64 with sides 66, 68. An opening 70 sized and shaped to receive pin 62, is formed between sides 66, 68 at the inside top of the "U." Clamp 64 fits between a pair of spaced apart flanges 72 extending outwardly from plate 58. Flanges 72 have openings 74 that are sized and shaped to receive pin 62. Plate 58 is coupled to clamp 64 by threading pin 62 through openings 74 in the plate and opening 70 in the clamp and then fixing pin 62 to plate 58 with screws 76. Pin 62 rotates freely within opening 70 of clamp 64, allowing plate 58 and the attached drywall tool to pivot relative to handle 10.

Figure 5:
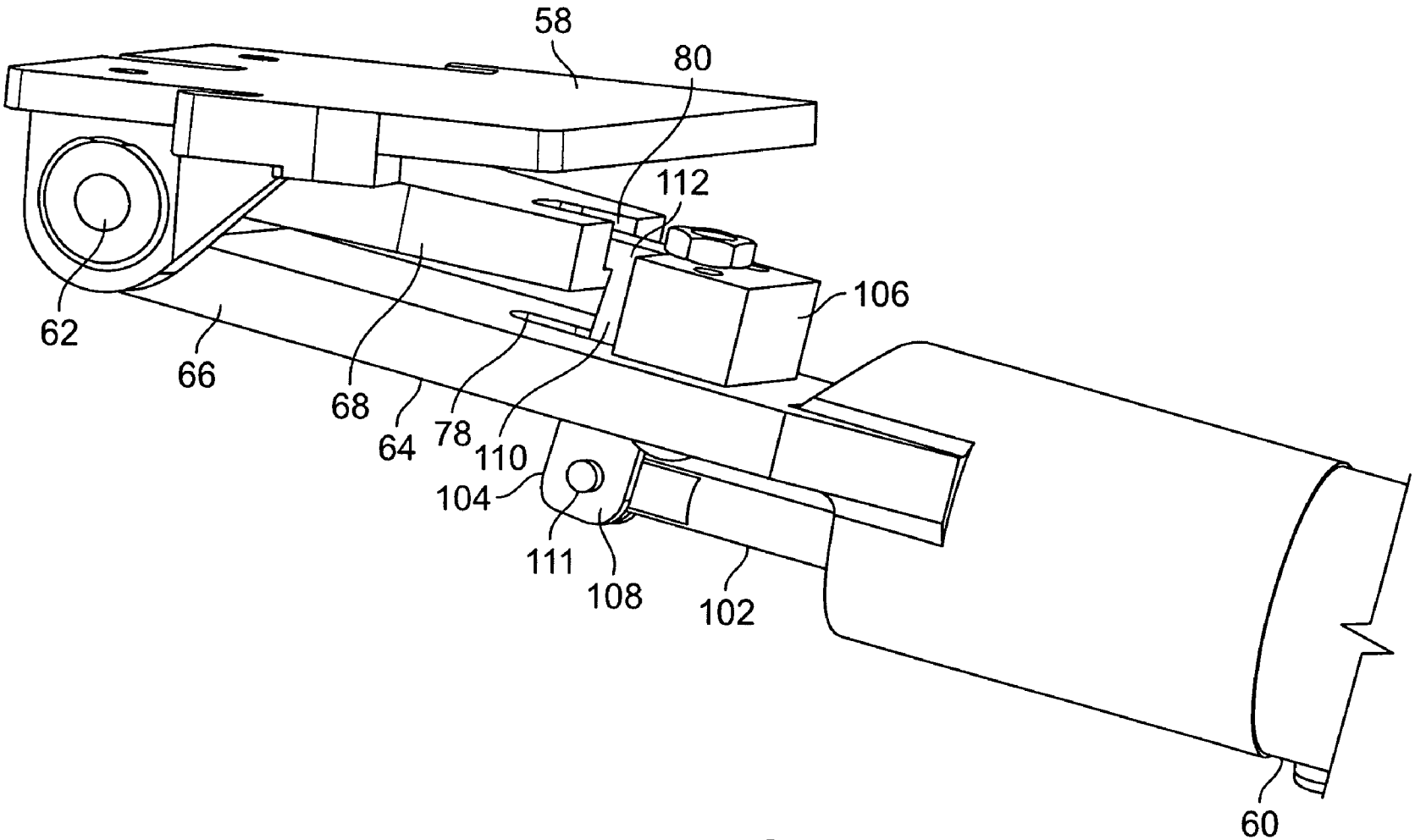
FIG. 5 is a detail perspective view of the drywall tool attachment plate of the handle of FIG. 1.

A brake assembly is used to control the rotation and fix the angle of plate 58 relative to handle 10. The brake assembly comprises a brake rod 102, lever 104 and block 106. Brake lever 104 has first and second ends 108, 110. First end 108 is pivotally connected to brake rod 102 by a pin 111. Second end 110 is inserted through an opening 78 in clamp 64, and second end 110 has a foot 112 that fits within a notch 80 formed in side 68 of the clamp, as best shown in FIG. 5. Brake block 106 is attached to clamp 64, and supports second end 110 of lever 104. Retracting rod 102 causes lever 104 to pivot against block 106 such that foot 112 exerts pressure on side 68 of clamp 64 to squeeze side 68 toward side 66. Squeezing sides 66, 68 of clamp 64 constricts opening 70 and causes the clamp to grip pin 62 and stop plate 58 from rotating relative to handle 10.

Brake rod 102 is actuated by squeezing the brake grip 114 positioned at end 82 of inner tube 12. As shown in FIG. 1, brake grip 114 and locking lever 26 are positioned 90° apart on the circumference of handle 10. In a preferred embodiment, brake grip 114 is oriented on handle 10 such that the user does not have to rotate the position of his hand or release his hold on handle 10 to comfortably operate brake grip 114.

Grip 114 is coupled to brake rod 102 by a connecting rod 116 that accommodates changes in the length of handle 10. As best shown in FIGS. 4, 6 and 7, brake rod 102 and connecting rod 116 are held parallel to each other within inner and outer tubes 12, 14 by housings 118, 120 positioned at opposite ends 82, 84 of the inner tube. Brake rod 102 is threaded through openings 122, 124 in housing 120. Connecting rod 116 is threaded through opening 126 in housing 120, and is seated in slots 128, 130 in housings 118, 120. Brake rod 102 and connecting rod 116 are free to slide relative to each other as inner tube 12 telescopes within outer tube 14.

Figure 8:
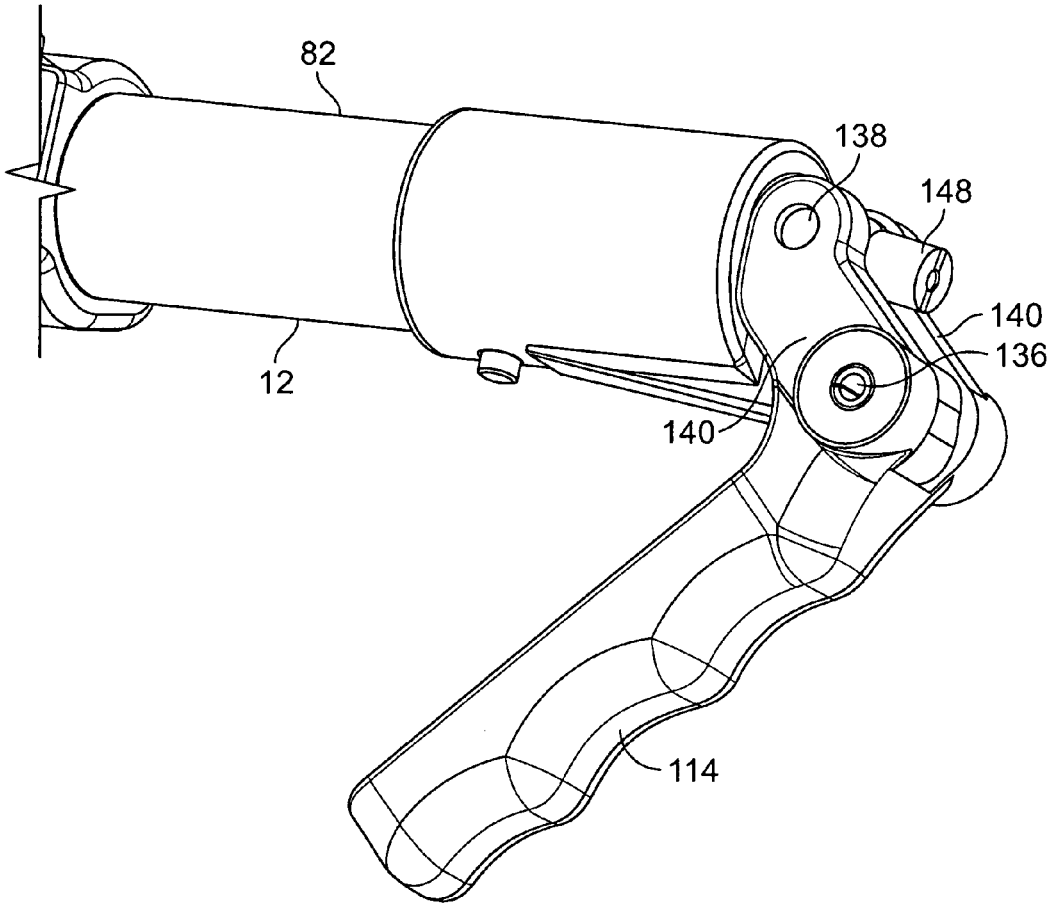
FIG. 8 is a detail perspective view of the brake grip of the handle of FIG. 1.

Connecting rod 116 has a first end 132 that is coupled to grip 114 (FIG. 4) and a second end 134 that is coupled to brake rod 102 (FIG. 7). First end 132 of connecting rod 116 terminates with a threaded link 144 that is pivotally connected to the main shaft 117 of connecting rod 16 by brackets 146. As best shown in FIGS. 4 and 8, grip 114 is pivotally connected to end 82 of inner tube 12 by a pin 136. Grip 114 includes a pivot 138 that is rotatably mounted in arms 140 that extend toward end 82. Link 144 is received in an opening 142 in pivot 138. An adjustment member, such as a nut 148 is mounted on threaded link 144 to retain link 144 in opening 142 and couple link 144 to pivot 138, such that, when grip 114 is actuated by squeezing, arms 140 rotate away from end 82 of inner tube 12 and pull connecting rod 116 longitudinally toward end 82.

The movement of connecting rod 116 causes brake rod 102 to retract and stop plate 58 from rotating relative to handle 10, as described above. As shown in FIGS. 6 and 7, end 134 of connecting rod 116 is pivotally connected to the base 150 of a washer 152 by brackets 154. Brake rod 102 is threaded through an opening 156 in washer 152. When inner and outer tubes 12, 14 are telescoped, brake rod 102 slides freely within opening 156 of washer 152. However, when connecting rod 116 is pulled by actuation of grip 114, a spring 158 causes washer 152 to pivot at the end 134 of the connecting rod such that the edges of opening 156 contact brake rod 102. The friction created by contact between washer 152 and brake rod 102 is sufficient to cause the brake rod to be pulled by the movement of connecting rod 116, thereby actuating the brake assembly to hold plate 58.

In a preferred embodiment, the distance between grip 114 and second end 134 of connecting rod 116 is adjustable, to ensure the proper operation of the brake assembly as the various parts of handle 10 loosen or become worn with use. Nut 148 may be rotated on threaded link 144 to pull connecting rod 116 longitudinally toward grip 114 (FIG. 8) and reduce the distance between second end 134 of the connecting rod 116 and grip 114. Nut 148 engages pivot 138 to prevent nut 148 from inadvertently rotating on link 144 and changing the distance between second end 134 of the connecting rod 116 and grip 114 during use. As best shown in FIG. 4, the inner end 160 of the nut 148 is scalloped to conform to the shape of pivot 138, such that nut 148 cannot rotate freely on link 144 while the nut it is in contact with the pivot. A spring 162 biases nut 148 toward pivot 138 to ensure that end 160 remains in contact with the pivot during normal use.

In operation, the user mounts a drywall tool, such as a flat finishing tool for applying mastic to a wall, to plate 58 on extendable handle 10. The user may then adjust the length of handle 10 to suit the task. For example, it may be useful to fully extend handle 10 to its greatest length to allow the user to reach the top and bottom of a wall in a single motion. The length of handle 10 is adjusted by applying hand pressure to locking lever 26 to disengage locking pin 28 from one of holes 18 along the length of inner tube 12. Inner and outer tubes 12, 14 are then telescoped to the desired length and the user releases pressure on locking lever 26 to allow locking pin 28 to engage the appropriate hole 18 and lock the inner and outer tubes together. Locking pin 28 is biased to engage holes 18 by spring 52.

As the user moves the drywall tool over the wall, plate 58 pivots on pin 62 to allow the tool to pivot at the end 60 of outer tube 14 and maintain contact with the surface of the wall. In some cases the user may wish to stop the drywall tool from pivoting and fix the angle of plate 58 relative to handle 10, such as when the flat finishing tool is removed from the wall after applying mastic. The user stops the rotation of plate 58 at the end 60 of outer tube 14 by squeezing brake grip 114. Pin 62 pivots within a clamp 64 that is coupled to grip 114 by brake rod 102 and connecting rod 116. Squeezing brake grip 114 pulls connecting rod 116 longitudinally toward end 82 of inner tube 12 and toward grip 114. Connecting rod 116 is coupled to brake 102 and causes the brake rod to retract and squeeze clamp 64 to hold pin 62 and prevent plate 58 from rotating. To compensate for wear or loosening of the parts from repeated use, the distance between second end 134 of connecting rod 116 and grip 114 is adjustable by turning nut 148 on link 144.

It will be apparent to those of skill in the art that modifications may be made without departing from the spirit and scope of the invention. Accordingly, it is not intended that the invention be limited except in view of the appended claims.

What is claimed is:

1. An extendable handle for a drywall tool, comprising:
first and second members slidably coupled to each other;
at least one opening on said first member; and
a locking assembly positioned on said second member for reversibly locking said first and second members together, said locking assembly including a base, a lever pivotally connected to said base, a pin, and a yoke, said lever and said pin spaced apart circumferentially on said handle and connected by said yoke;
wherein said pin engages said opening when said first and second members are locked together.

2. The handle of claim 1, further comprising a spring for biasing said pin toward said opening, and wherein said lever is actuated against said spring bias to withdraw said pin from said opening.

3. The handle of claim 1, wherein said lever has a narrow end pivotally connected to said base and a wide end connected to said yoke.

4. The handle of claim 1, further comprising:
a plate adapted for mounting a drywall tool on said handle, said plate rotatably connected to said second member;
a brake for controlling the rotation of said plate relative to said second member;
a grip for actuating said brake, said grip connected to said first member; and
a connecting rod having first and second ends, said first end coupled to said grip and said second end coupled to said brake;
wherein the distance between said grip and said second end of said connecting rod is adjustable.

5. The handle of claim 4, further comprising an adjustment member coupled to said first end of said connecting rod for adjusting the distance between said grip and said second end of said connecting rod.

6. The handle of claim 4, wherein said first end of said connecting rod is pivotally coupled to said grip.

7. The handle of claim 4, wherein said lever and said grip are positioned approximately 90° apart on the circumference of said handle.

8. An extendable handle for a drywall tool, comprising:
first and second members slidably coupled to each other;
a lock positioned on said handle, for reversibly locking said first and second members together;
a lever positioned on said handle for actuating said lock, said lever and said lock spaced apart circumferentially on said handle; and
a yoke connecting said lever and said lock; and
a slot in said handle for receiving said yoke, wherein said yoke does not extend beyond said slot during actuation of said lock.

9. The handle of claim 8, further comprising at least one opening on said first member; and wherein said lock is a pin positioned on said second member, said pin engaged in said opening when said first and second members are locked together.

10. The handle of claim 9, wherein said pin is spring-biased to engage said opening and said lever is actuated against said spring-bias to withdraw said pin from said opening.

11. The handle of claim 8, further comprising:
a plate adapted for mounting a drywall tool on said handle, said plate rotatably connected to said second member;
a brake for controlling the rotation of said plate relative to said second member;
a grip for actuating said brake, said grip connected to said first member; and
a connecting rod having first and second ends, said first end coupled to said grip and said second end coupled to said brake;
wherein the distance between said grip and said second end of said connecting rod is adjustable.

12. The handle of claim 11, further comprising an adjustment member coupled to said first end of said connecting rod for adjusting the distance between said grip and said second end of said connecting rod.

13. The handle of claim 12, wherein said first end of said connecting rod is threaded and said adjustment member is a nut.

14. The handle of claim 11, wherein said first end of said connecting rod is pivotally coupled to said grip.

15. The handle of claim 11, wherein said lever and said grip are positioned approximately 90° apart on the circumference of said handle.

16. An extendable handle for a drywall tool, comprising:
first and second members slidably coupled to each other;
a lock positioned on said coupled first and second members for reversibly locking said first and second members together;
a lever positioned on said coupled first and second members for actuating said lock to unlock said first and second members, said lever and said lock spaced apart circumferentially on said coupled first and second members;
a brake for controlling the rotation of said drywall tool relative to said coupled first and second members;
a grip positioned on said coupled first and second members, the movement of said grip actuating said brake; and
a connecting rod having first and second ends, said first end coupled to said grip and said second end coupled to said brake;
an adjustment member coupled to said first end of said connecting rod for adjusting the distance between said grip and said second end of said connecting rod,
wherein the distance between said grip and said second end of said connecting rod is adjustable, and
wherein said first end of said connecting rod is threaded and said adjustment member is a nut.

17. The handle of claim 16 wherein said connecting rod comprises a main shaft pivotally connected to a link, said link positioned at said first end of said connecting rod and coupled to said grip.

18. The tool of claim 16, wherein said grip includes a pivot, said first end of said connecting rod coupled to said grip by said pivot.

19. The tool of claim 18, wherein said adjustment member engages said pivot to prevent said adjustment member from changing the distance between said grip and said second end of said connecting rod.

20. The tool of claim 19, wherein at least part of said adjustment member is shaped to conform to said pivot.

21. An extendable handle for a drywall tool, comprising:
first and second members slidably coupled to each other;
at least one opening on said first member; and
a locking assembly positioned on said second member for reversibly locking said first and second members together, said locking assembly including a base, a lever pivotally connected to said base, a pin, and a yoke, said lever and said pin spaced apart circumferentially on said handle and connected by said yoke;
a slot in said base for receiving said yoke, and wherein said base has an outer surface and said yoke does not extend beyond said outer surface of said base;
wherein said pin engages said opening when said first and second members are locked together.

22. An extendable handle for a drywall tool, comprising:
first and second members slidably coupled to each other;
at least one opening on said first member; and
a locking assembly positioned on said second member for reversibly locking said first and second members together, said locking assembly including a base, a lever pivotally connected to said base, a pin, and a yoke, said lever and said pin spaced apart circumferentially on said handle and connected by said yoke;
wherein said pin engages said opening when said first and second members are locked together;
a plate adapted for mounting a drywall tool on said handle, said plate rotatably connected to said second member;
a brake for controlling the rotation of said plate relative to said second member;
a grip for actuating said brake, said grip connected to said first member;
a connecting rod having first and second ends, said first end coupled to said grip and said second end coupled to said brake;
wherein the distance between said grip and second end of said connecting rod is adjustable;
an adjustment member coupled to said first end of said connecting rod for adjusting the distance between said grip and said second end of said connecting rod;
wherein said first end of said connecting rod is threaded and said adjustment member is a nut.

23. An extendable handle for a drywall tool, comprising:
first and second members slidably coupled to each other;
a lock positioned on said coupled first and second members for reversibly locking said first and second members together;
a lever positioned on said coupled first and second members for actuating said lock to unlock said first and second members, said lever and said lock spaced apart circumferentially on said coupled first and second members;
a brake for controlling the rotation of said drywall tool relative to said coupled first and second members;
a grip positioned on said coupled first and second members, the movement of said grip actuating said brake;
a connecting rod having first and second ends, said first end coupled to said grip and said second end coupled to said brake;
an adjustment member coupled to said first end of said connecting rod for adjusting the distance between said grip and said second end of said connecting rod,
wherein the distance between said grip and said second end of said connecting rod is adjustable,
wherein said grip includes a pivot, said first end of said connecting rod coupled to said grip by said pivot;
wherein said adjustment member engages said pivot to prevent said adjustment member from changing the distance between said grip and said second end of said connecting rod;
wherein at least part of said adjustment member is shaped to conform to said pivot; and
wherein the first end of said connecting rod is threaded and said adjustment member is a nut.

* * * * *